US006622770B1

(12) United States Patent
Tyner

(10) Patent No.: US 6,622,770 B1
(45) Date of Patent: Sep. 23, 2003

(54) TAPE DRUM FOR VENETIAN TYPE BLINDS

(75) Inventor: James D. Tyner, Clarmont, FL (US)

(73) Assignee: ITA, Inc., St. Augustine, FL (US)

( * ) Notice: Subject to any disclaimer, the term of this patent is extended or adjusted under 35 U.S.C. 154(b) by 0 days.

(21) Appl. No.: 10/102,229

(22) Filed: Mar. 20, 2002

(51) Int. Cl.[7] ..... E06B 9/30
(52) U.S. Cl. ..... 160/178.1 R; 160/177 R
(58) Field of Search ..... 160/168.1 R, 170 R, 160/173 R, 176.1 R, 177 R, 178.1 R, 178.3 R

(56) References Cited

U.S. PATENT DOCUMENTS

| | | | | | |
|---|---|---|---|---|---|
| 2,055,826 | A | | 9/1936 | Nottingham | |
| 2,200,349 | A | | 5/1940 | Walker | |
| 2,544,184 | A | | 3/1951 | Rosenbaum | |
| 2,589,846 | A | * | 3/1952 | Nelson | 160/177 R |
| 2,620,867 | A | * | 12/1952 | Rosenbaum | 160/177 R |
| 2,667,220 | A | * | 1/1954 | Rutledge | 160/177 R |
| 2,670,038 | A | | 2/1954 | Lorentzen | |
| 2,742,962 | A | | 4/1956 | Griesser | |
| 2,831,536 | A | * | 4/1958 | Lorentzen | 160/177 R |
| 3,306,343 | A | * | 2/1967 | Hensel | 160/177 R |
| 4,651,794 | A | | 3/1987 | Bytheway, Jr. | |
| 4,821,789 | A | * | 4/1989 | Van Rens | 160/176.1 R |
| 5,074,349 | A | * | 12/1991 | Yannazzone | 160/177 R |
| 5,139,073 | A | * | 8/1992 | Opdahl et al. | 160/177 R |
| 5,267,598 | A | * | 12/1993 | Marocco | 160/177 R |
| 5,538,068 | A | * | 7/1996 | Liu | 160/177 R |
| 5,573,052 | A | * | 11/1996 | Liu | 160/177.2 R |
| 6,279,642 | B1 | * | 8/2001 | Liu | 160/177 R |
| 6,302,182 | B1 | * | 10/2001 | Anderson | 160/177 R |
| 6,321,820 | B1 | * | 11/2001 | Liu | 160/177 R |
| 6,527,034 | B1 | * | 3/2003 | Liu | 160/177 R |

* cited by examiner

*Primary Examiner*—Bruce A. Lev
(74) *Attorney, Agent, or Firm*—Buchanan Ingersoll, P.C.

(57) ABSTRACT

A tape drum for venetian type blinds has a pair of spaced apart generally elliptical ends with each end having a hole sized and positioned to receive a tilt axle. A front wall and a rear wall extend between the spaced apart ends. A rib is attached to the front wall and to the inside surfaces of the spaced apart ends. A second rib is attached to the rear wall and the inside surfaces of the spaced apart ends, the second rib being spaced apart from the first rib and defining a gap between the first rib and the second rib. A mounting is attached to each rib that is sized and configured so that a rail of a cord ladder can be attached to it. Two pairs of collinear spaced apart rods are attached to the inside surfaces of the spaced apart ends to provide a mounting for the rails of a tape type ladder. The generally elliptical shape of the tape drum causes the rails of the ladder to move together when the tilt axle is turned from an open position to a closed position.

8 Claims, 4 Drawing Sheets

TAPE DRUM FOR VENETIAN TYPE BLINDS

FIELD OF INVENTION

The invention relates to venetian type blinds and particularly to the drum inside the headrail to which a ladder that carries the slats in a venetian blind is attached.

BACKGROUND OF THE INVENTION

Venetian type blinds have a series of slats hung on ladders that extend from a headrail to a bottomrail. The slats rest on rungs between rails of the ladders. The number of ladders will vary according to the width of the blind. However, all venetian blinds have at least two ladders. In most venetian blinds the upper end of each ladder is attached to a drum. The drums are carried on a tilt axle within the headrail. The tilt axle is connected to a tilt mechanism that enables the tilt axle to be turned in a clockwise direction as well as in a counterclockwise direction. The blind is in an open position when the rungs are horizontal. To close the blind one turns the tilt axle in either a clockwise direction or a counterclockwise direction. This turns the drums on the tilt axle lifting one rail while allowing the other rail to be lowered thereby raising one end and lowering the opposite end of each rung tilting the slats. Turning the tilt axle and attached drums in an opposite direction opens the blind. The rails originally used for ladders in venetian blinds consisted of a fabric tape typically from one to two inches in width. The rungs were also made of fabric strips. Very few tape type ladders are used in blinds today. Rather, the art has adopted ladders formed of cord rails having cord-type rungs between them. Typically, the rungs are multiple strands of cord. However, a single strand of cord has also been used. Frequently, a braided cord is used for the ladder rails.

In most Venetian type blinds the drums that hold the rails of the ladders are circular or nearly circular. Consequently, when such a drum turns, the upper portion of the rails of the ladder cannot move together when the blind is changed from an open position to a closed position. That is so because all diameters of the tape drum are the same or nearly the same. Because the rails cannot move together at the top of the blind the upper slat does not close tightly allowing more light to pass through the blind at the location of the top slat than would pass if the ladders had moved together. This problem can be overcome by using a tilt system in which the upper portion of the rails move together. Such a tilt system has been disclosed by Judkins in U.S. Pat. No. 5,573,051. The tilt mechanism disclosed by Judkins has a disk to which the rails of the tilt ladder are connected. There is one disk for each tilt ladder. The disks are mounted on a tilt rod so that rotation of the tilt rod will turn the disks in unison. This tilt mechanism requires special hardware and requires routing the lift cords through the disks. It cannot be easily retrofitted into existing headrails. Furthermore, the tilt mechanism disclosed by Judkins ca only be used for cord type ladders.

There is a need for a drum that supports the rails of a ladder in a venetian type blind and allows the ladder rails to move together at the top of the blind when the blind is closed. This drum should be easy to install, able to handle both cord ladders and tape ladders and be suitable for use on existing blinds. Such a tape drum should also be inexpensive and easy to make.

SUMMARY OF THE INVENTION

I provide a tape drum for a venetian type blind that has two elongated ends that are generally elliptical or oval in shape. The major diameter preferably is about twice the minor diameter. There is a front wall and a rear wall extending between the two ends. A rib extends inward from each of the front side and the rear side. These two inwardly extending ribs are in a common plane but are spaced apart. A bracket or mounting is attached to each wall, the brackets being sized and configured so that a cord rail can be easily attached to it. A pair of spaced apart rods extend inward from the inside surface of each elongated end. The rods are positioned so that there are two pairs of rods in which the rods in each pair are collinear but are spaced apart from one another. These rods provide a mounting for tape ladders and are sized for attachment of a tape rail to each collinear pair of rods. A hole is provided in each elongated end to permit the drum to be slid onto a tilt axle. The holes are the same shape as the cross-section of the tilt axle. When the tilt mechanism closes the blind the rails of the ladder move together throughout the length of the ladder and particularly in the region of the top slat.

Although the preferred embodiment has mountings for both tape ladder rails and cord ladder rails, the drum could be made with either but not both type of mountings.

Other objects and advantages of the present invention will become apparent from a description of the present preferred embodiments shown in the drawings.

DESCRIPTION OF THE PREFERRED EMBODIMENTS

Figure 7:
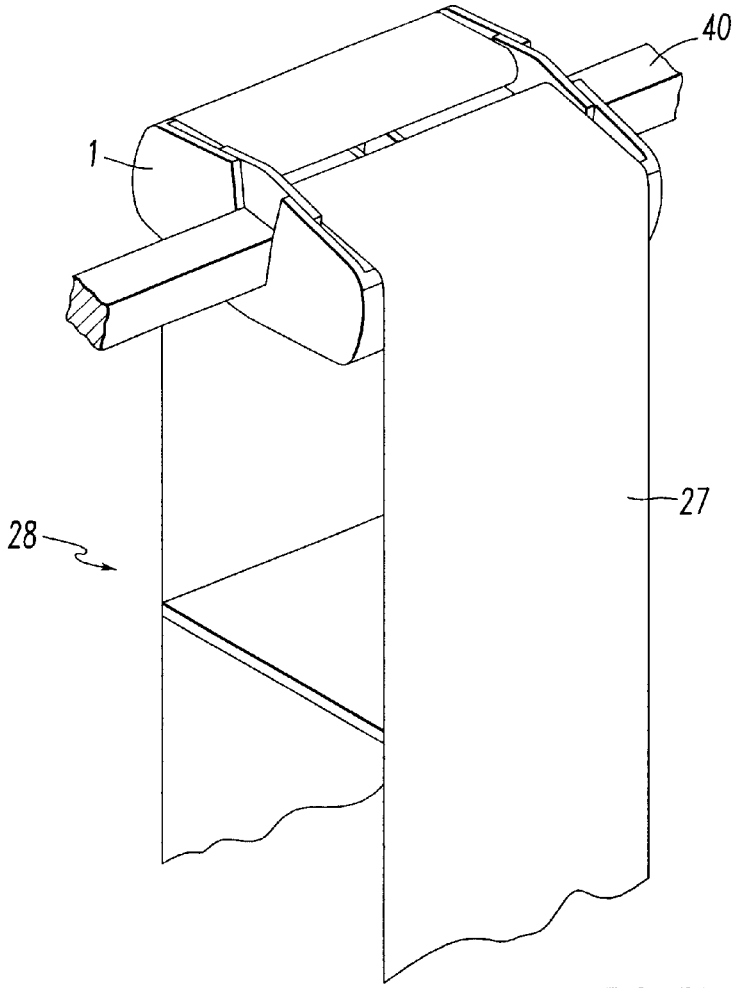
FIG. 7 is a perspective view of the embodiment of FIGS. 1 and 2 on a tilt axle with a tape ladder when the blind is in an open position.
Figure 8:
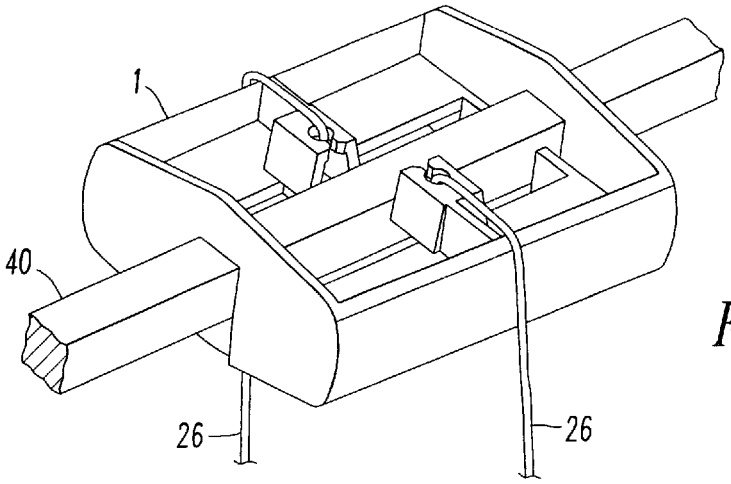
FIG. 8 is a perspective view similar to FIG. 7 showing the tape drum on a tilt axle with a cord ladder attached.

A present preferred embodiment of my tape drum 1 has two spaced apart ends 2 and 4 that are generally elliptical or oval yet have some straight edges. Preferably the major diameter is approximately twice the minor diameter. I prefer that the ends have a major diameter or length of 1.50 inches and a minor diameter or width of 0.75 inches. The tape drum 1 is fitted onto a tilt axle 40 as shown in FIGS. 7 and 8. Consequently, there is a hole 5 in each end 2 and 4 through which the tilt axle can pass. This hole is shaped to have the same shape as the cross section of the tilt axle on which it is carried. One commonly used tilt axle is a square rod having 0.250 inch sides. Therefore, I prefer to provide a square hole having 0.26 inch sides. This size hole will provide a sufficiently tight fit to permit the tape drum to be readily positioned on the tilt axle while preventing the tape drum from easily sliding along the tilt axle after a ladder has been attached. There is a front wall 6 and a rear wall 8 connected between the two ends 2 and 4 at the front edges 62 and 64 or the rear edges 82 and 84 of those ends. I prefer that these walls be about 1.5 inched in length. Extending inwardly from the front wall is a support rib 10. A second support rib 12 extends inwardly from the rear wall 8. The two support ribs are coplanar but do not meet. Consequently, there is a space 11 between them. A bracket or mounting 16 is attached to the top surface of each rib 10 and 12. These two brackets are offset from one another and may extend slightly into the space 11 between the ribs 10 and 12. Each bracket 16 has a slot 15 terminating in a hole 17. The slot and hole are sized to receive a rail 26 of a cord ladder as shown in FIG. 8. The rail extends from the mounting 16 over the front wall or the rear wall. The end of each rail 26 may be knotted or clipped to prevent the rail from slipping through the hole. I prefer to provide a beveled entrance 18 to the slot to make it easier to insert the cord rail into the slot 15.

Figure 1:
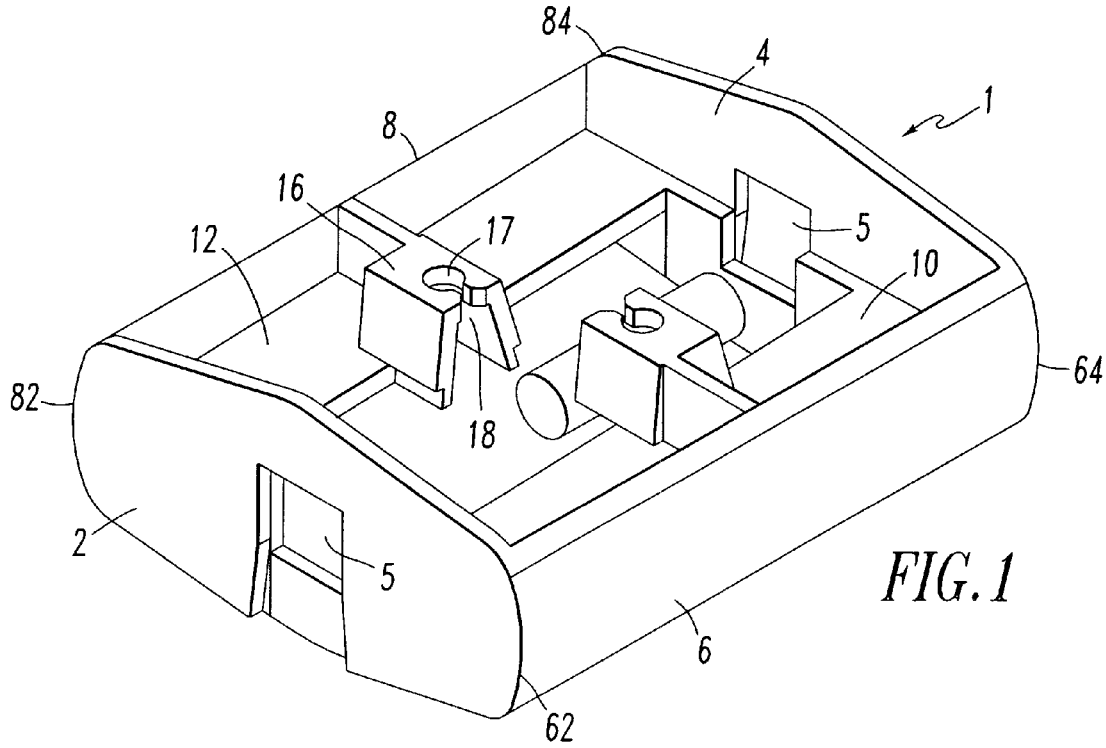
FIG. 1 is a perspective view of a present preferred embodiment of my tape drum for a venetian type blind showing the top, front and end of the drum.
Figure 2:
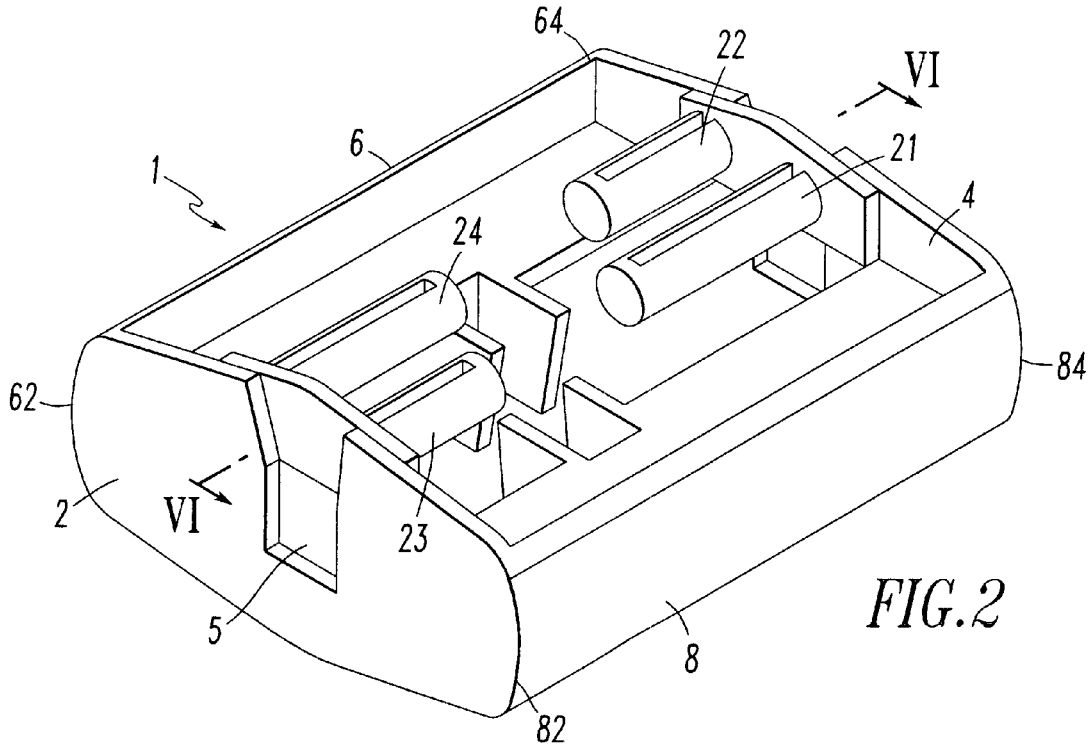
FIG. 2 is a perspective view similar to FIG. 1 showing the bottom, rear and end of the tape drum shown in FIG. 1.
Figure 3:
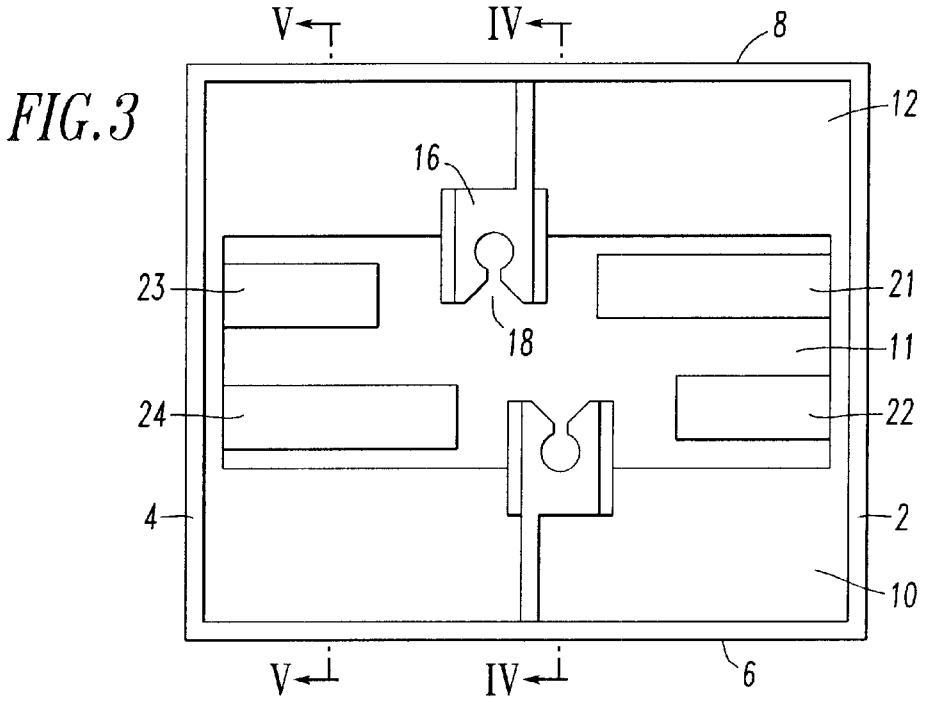
FIG. 3 is a top plan view of the embodiment shown in FIGS. 1 and 2.
Figure 4:
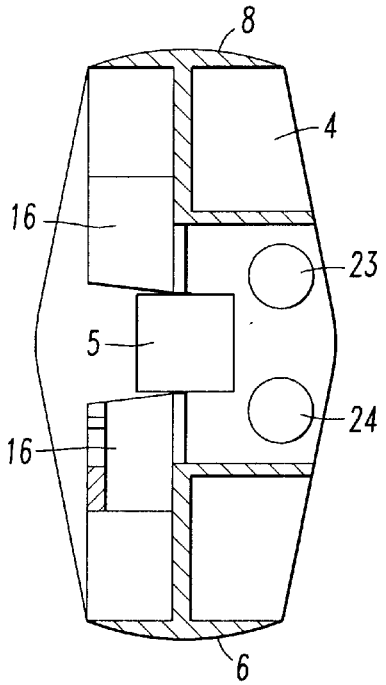
FIG. 4 is a sectional view taken along the line IV—IV of FIG. 3.
Figure 5:
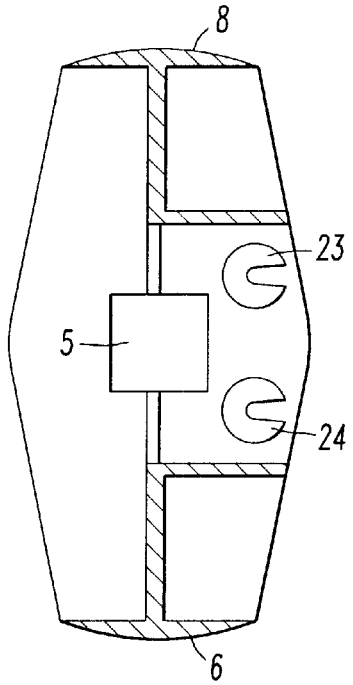
FIG. 5 is a sectional view taken along the line V—V of FIG. 3.
Figure 6:
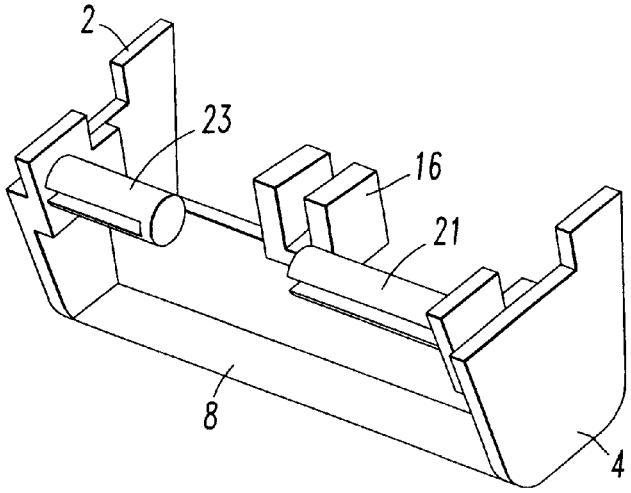
FIG. 6 is a sectional view taken along the line VI—VI in FIG. 2.

The tape drum 1 can also hold a tape ladder 28 as shown in FIG. 7. The rails 27 of the tape ladder are attached to rods 21, 22, 23 and 24 extending from ends 2 and 4 opposite the bottom surface of the ribs 10 and 12 and shown in FIGS. 1, 5 and 6. Two rods 21 and 22 extend from end 2 and the other two rods 23 and 24 extend from the opposite end 4. The rods are positioned so that pairs of rods 21 and 23 as well as 22 and 24 are collinear but do not meet. In a preferred embodiment the rods in each pair of rods are of different lengths as shown. I prefer to make rods 22 and 23 to be 0.35 inches in length and rods 21 and 24 to be 0.55 inches in length. Those dimensions provide a gap of 0.63 inches between each pair of aligned rods 22 and 24 or 21 and 23. However, the gaps are offset rather than directly opposite one another. To attach a tape ladder to the rods the rails of the tape ladders are each folded back on themselves and bonded or sewn to form a loop that receives rods 21 and 23 or rods 22 and 24 and thus holds the tape ladder on the tape drum. The rails 27 are routed through the gap 11 between the ribs 10 and 12 and over the front wall 6 or rear wall 8 as shown in FIG. 7.

The particular configuration of the tape drum shown in the Figures permits the drum to be molded as a single plastic piece. For that reason this tape drum can be made in a multi-cavity mold at a very low cost. The illustrated configuration also enables the rails of a cord ladder or a tape ladder to be easily attached to the drum. Another important feature of this tape drum is that it can be used in any venetian type blind and retrofitted onto existing blinds. Should the blind have a tilt axle that has a cross section other than square it is relatively inexpensive to replace the tilt axle with one having a square cross section. Alternatively, the hole 5 could be made to have a different noncircular cross-section, such as triangular or hexagonal, that corresponds to the cross section of the tilt axle on which the drum is to be mounted.

Figure 9:
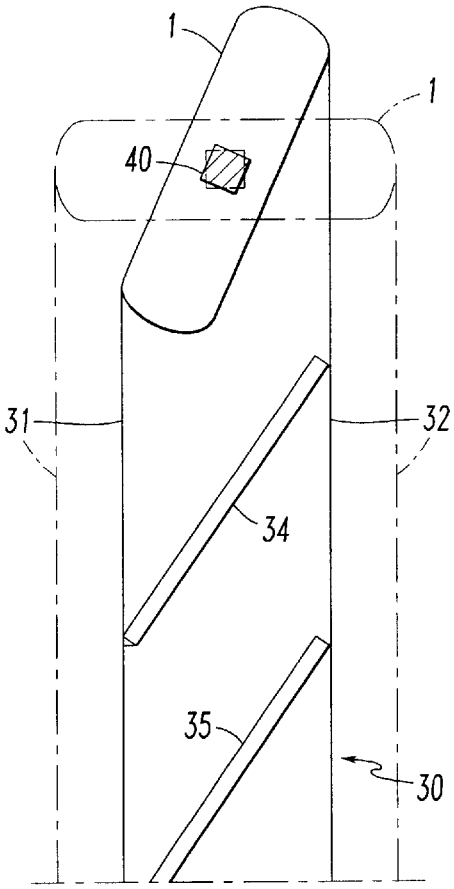
FIG. 9 is an end view of the tape drum on a tilt axle and with a ladder attached. The tape drum is oriented to a position where the blind is in a closed position. The position of the tape drum and ladder when the blind is in an open position is shown in dotted line.
Figure 10:
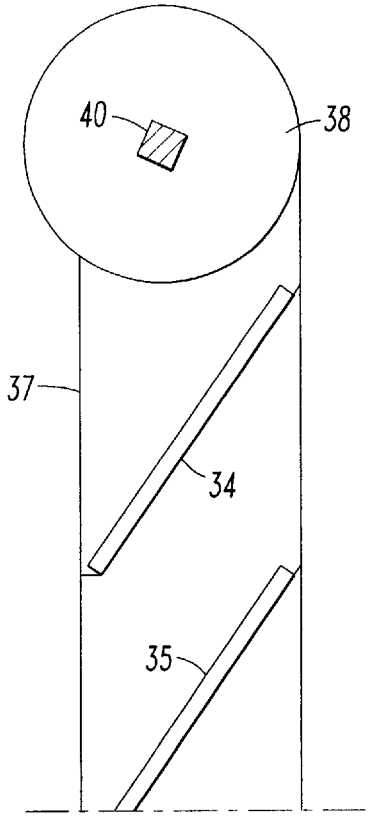
FIG. 10 PRIOR ART
FIG. 10 is an end view similar to FIG. 9 of a conventional circular tape drum on a tilt axle and with a ladder attached when the blind is in a closed position.

Shown in FIG. 9 is an end view of the tape drum 1 in a position where the tilt axle 40 has been turned to close the blind. The dotted lines in FIG. 9 show the position of the drum 1 and attached ladder when the blind is in an open position. It is apparent from the drawing that the rails 31 and 32 of the ladder 30 have moved together when the tilt axle 40 was turned. As a consequence of that movement the slats 34 and 35 are at a steep angle and the lower edge of the top slat 34 overlaps the upper edge of the slat 35 below it. This is in contrast to the non-overlapping position of the top slat 34 and the second slat 35 on a ladder 37 held on a conventional circular tape drum 38 shown in FIG. 10.

Even though the present preferred embodiment is designed to receive both tape ladders and cord ladders one could eliminate the brackets 16 so that the tape drum would only hold tape ladders. If the tape drum was intended for use only with cord ladders then rods 21,22, 23 and 24 could be eliminated. If only a cord ladder is to be attached, the ribs 10 and 12 could be extended to close the gap 11 and form a single wall. In yet another embodiment the ribs could be eliminated and the brackets 16 could be attached directly to the front and rear walls 6 and 8.

Although I have shown and described certain present preferred embodiments of my tape drum for venetian type blinds it should be distinctly understood that the invention is not limited thereto but may be variously embodied within the scope of the following claims.

I claim:

1. A tape drum for venetian blinds comprising:

a pair of spaced apart ends each end having:

a generally elliptical shape defining a front edge and a rear edge, an inside surface, and a hole sized and positioned to receive a tilt axle;

a front wall extending between the front edges of the spaced apart ends;

a rear wall extending between the rear edges of the spaced apart ends;

a first rib attached to the front wall and to the inside surfaces of the spaced apart ends;

a second rib attached to the rear wall and to the inside surfaces of the spaced apart ends, the second rib being spaced apart from the first rib and defining a gap between the first rib and the second rib;

a first mounting attached to the first rib, the first mounting sized and configured so that a rail of a cord ladder can be attached to the first mounting;

a second mounting attached to the second rib, the second mounting sized and configured so that a rail of a cord ladder can be attached to the second mounting;

a first pair of collinear spaced apart rods, one rod attached to the inside surface of one of the spaced apart ends and the second rod attached to the inside surface of the other spaced apart end; and a second pair of collinear spaced apart rods, one rod attached to the inside surface of one of the spaced apart ends and the second rod attached to the inside surface of the other spaced apart end.

2. The tape drum of claim 1 wherein the spaced apart ends have a major diameter and a minor diameter, the major diameter being about twice the minor diameter.

3. The tape drum of claim 2 wherein the tape drum is plastic.

4. The tape drum of claim 1 wherein the tape drum is a one piece molded structure.

5. The tape drum of claim 1 wherein the first mounting has a slot sized to receive a rail of a cord ladder.

6. The tape drum of claim 5 wherein the first mounting has a beveled entrance to the slot.

7. The tape drum of claim 1 wherein the tape drum is a one piece molded structure.

8. The tape drum of claim 7 wherein the tape drum is plastic.

* * * * *